US005797790A

United States Patent [19]

Rindoks et al.

[11] Patent Number: 5,797,790

[45] Date of Patent: *Aug. 25, 1998

[54] FUME HOOD

[75] Inventors: Kurt Rindoks, Davidson; S. Ross Lyons, Huntersville, both of N.C.

[73] Assignee: Kewaunee Scientific Corporation, Statesville, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 573,253

[22] Filed: Dec. 15, 1995

[51] Int. Cl.[6] ..... B08B 15/02

[52] U.S. Cl. ..... 454/59

[58] Field of Search ..... 454/56, 59

[56] References Cited

U.S. PATENT DOCUMENTS

| | | | |
|---|---|---|---|
| 2,819,666 | 1/1958 | McNeil et al. | 454/59 |
| 3,111,077 | 11/1963 | Cortright | 454/59 |
| 3,318,227 | 5/1967 | Nelson et al. | 454/54 |
| 3,340,788 | 9/1967 | Landingham et al. | 454/59 |
| 4,023,473 | 5/1977 | Russell . | |
| 4,142,458 | 3/1979 | Duym . | |
| 4,249,463 | 2/1981 | Hornby . | |
| 4,377,969 | 3/1983 | Nelson . | |
| 4,856,420 | 8/1989 | Poblete et al. | 454/54 |

FOREIGN PATENT DOCUMENTS

| | | | |
|---|---|---|---|
| 99776 | 11/1961 | Netherlands | 454/59 |
| 2 086 035 | 5/1982 | United Kingdom | 454/59 |

OTHER PUBLICATIONS

"Laboratory Fume Hoods", Catalog No. FH-51, Kewaunee Scientific Equipment Corporation, pp. 1, 5, and 77.

*Primary Examiner*—Harold Joyce
*Attorney, Agent, or Firm*—Hill & Simpson

[57] ABSTRACT

A compact fume hood arrangement includes a bypass channel mounted to a top panel of the fume hood which effectively extends a front open face of the fume hood upwardly providing an air path through the bypass channel which provides sufficient air flow to prevent disadvantageous air currents due to excessive face velocity. A vertical sash can be used such that raising of the sash proportionally closes the bypass channel while opening the open face of the fume hood.

6 Claims, 3 Drawing Sheets

24a
36
34
24
34a
38
48
A
40
44b
32
12a
44
44a
V
12
24
18
30

FUME HOOD

BACKGROUND OF THE INVENTION

The present invention relates to laboratory fume hoods. Particularly, the invention relates to fume hoods having air flow arrangement for sweeping the interior area of the fume hood when the front sash is in an open or a closed orientation.

The basic concept behind hood design is to protect the user. The hood should provide sufficient air flow across the face/opening to protect the user from harmful fumes given off by experiments within the hood. However, if the velocity of air entering the hood is too high, extremely turbulent air patterns inside the hood could compromise the hood's containment putting the user in danger. The efficiency of the hood is also adversely affected if too much air is being exhausted.

A bypass area provides a means to control the velocity of the air across the face of the hood throughout the range of motion for the sash.

Typically, a fume hood provides a vertically positionable sash liftable to allow a laboratory worker to move his hands within the hood to manipulate his samples. When, however, the sash is closed, air must be provided to pass through the hood to sweep the hood of generated gases or other undesired volatile materials. Typically, the bypass is located between the front of the hood, the area in front of the sash glass. This bypass provides air to the interior of the hood while the sash is in the closed position. However, this space must be sufficient to provide enough air to prevent extremely high velocity air from entering the hood when the sash is only open a small amount. These high velocities may cause adverse air patterns inside the hood. Since this bypass area is typically located in front of the sash, the working space within the hood is compromised. Such fume hoods are disclosed in, for example, U.S. Pat Nos. 3,318,227, 4,142,458 and 4,377,969.

Alternatively, fume hoods can have horizontally reciprocal sashes such as disclosed in U.S. Pat. No. 4,023,473 or combination vertical and horizontal sash, such as described in U.S. Pat. No. 4,142,458.

SUMMARY OF THE INVENTION

It is an object of the present invention to provide a fume hood which is compact in size and arrangement. It is an object of the present invention to provide a fume hood which provides sufficient sweeping air during a period when the front sash is closed and also when the front sash is opened during manipulation inside the hood by the laboratory technician. It is an object of the present invention to provide sufficient bypass air flow area to provide enough air to prevent extremely high velocity air from entering the hood when the sash is opened only a small amount.

It is an object of the invention to provide a fume hood cabinet which maximizes the working area for a particular size cabinet.

The object of the present invention is achieved by a fume hood provided in the form of a cabinet having a front sash pane liftable for access by a laboratory technician into the cabinet of the fume hood. A bypass is provided for air to pass into the fume hood when the pane is closed. This bypass is located behind the sash. As the sash is opened by raising, the bypass is closed off proportionately, forcing more air to be supplied through the opened front of the hood. The arrangement provides a means of controlling the velocity of the air entering the hood while providing the necessary containment to protect the laboratory technician.

Alternately, a bypass can be provided behind the sash for fume hoods having horizontally reciprocal sashes or combination vertical/horizontal operated sashes.

The objects are inventively achieved in that a channeled bypass element is mounted on a top level of the hood behind the sash.

The objects are achieved in that the channeled bypass element is a box shaped elongate channel with an open front face and an open bottom face. The hood provides a cabinet with a top wall, bottom wall and side walls. An area is preserved behind the channel for mounting other equipment. The elongate channel effectively extends the bypass area of the cabinet behind the sash resulting overall in a compact design.

DETAILED DESCRIPTION OF THE PREFERRED EMBODIMENTS

Figure 1:
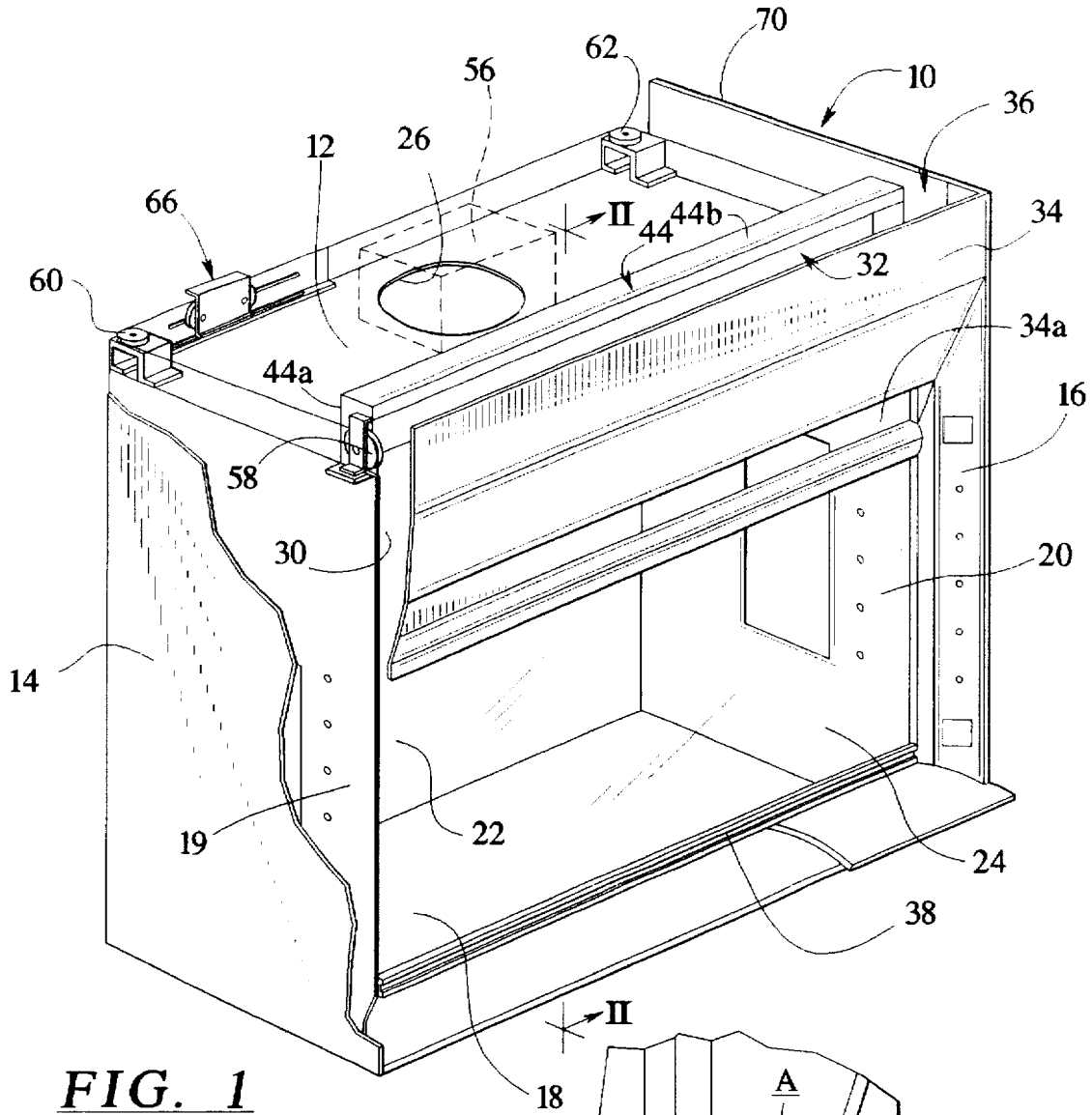
FIG. 1 is a partial perspective view of a fume hood of the present invention.

FIG. 1 discloses a fume hood 10 of the present invention. The fume hood 10 is a cabinet structure having a top panel 12, cover side panels 14, 16 and a bottom panel 18. A back panel 22 and a front sash 24 and inside walls 19, 20 are provided to form a substantially closed working area. A baffle 80 (shown in FIG. 7) is not shown in FIG. 1, for clarity. An air outlet 26 through the top wall 12 allows for fan suction of air through and out of the fume hood 10. When the front sash 24 is in a lowered or closed position as illustrated in FIG. 1, an open face 30 is left between the top of the front sash 24 and the top panel 12. A fixed front panel 34 is spaced outwardly and forwardly from a plane defined by the front sash and confronts the open face 30. The fixed front panel 34 may also include as illustrated in FIG. 1 a glass portion **34*a* for viewing into the working area of the flume hood. An open area or gap 36 lying in a horizontal plane is provided between the front panel 34 and the plane defined by the front sash 24 for permitting downward passage of air into the working area. The sash 24 is guided by conventional means for vertical sliding movement between the sidewalls 19 and 20** within the plane of the front sash.

Figures 2, 3, 4:
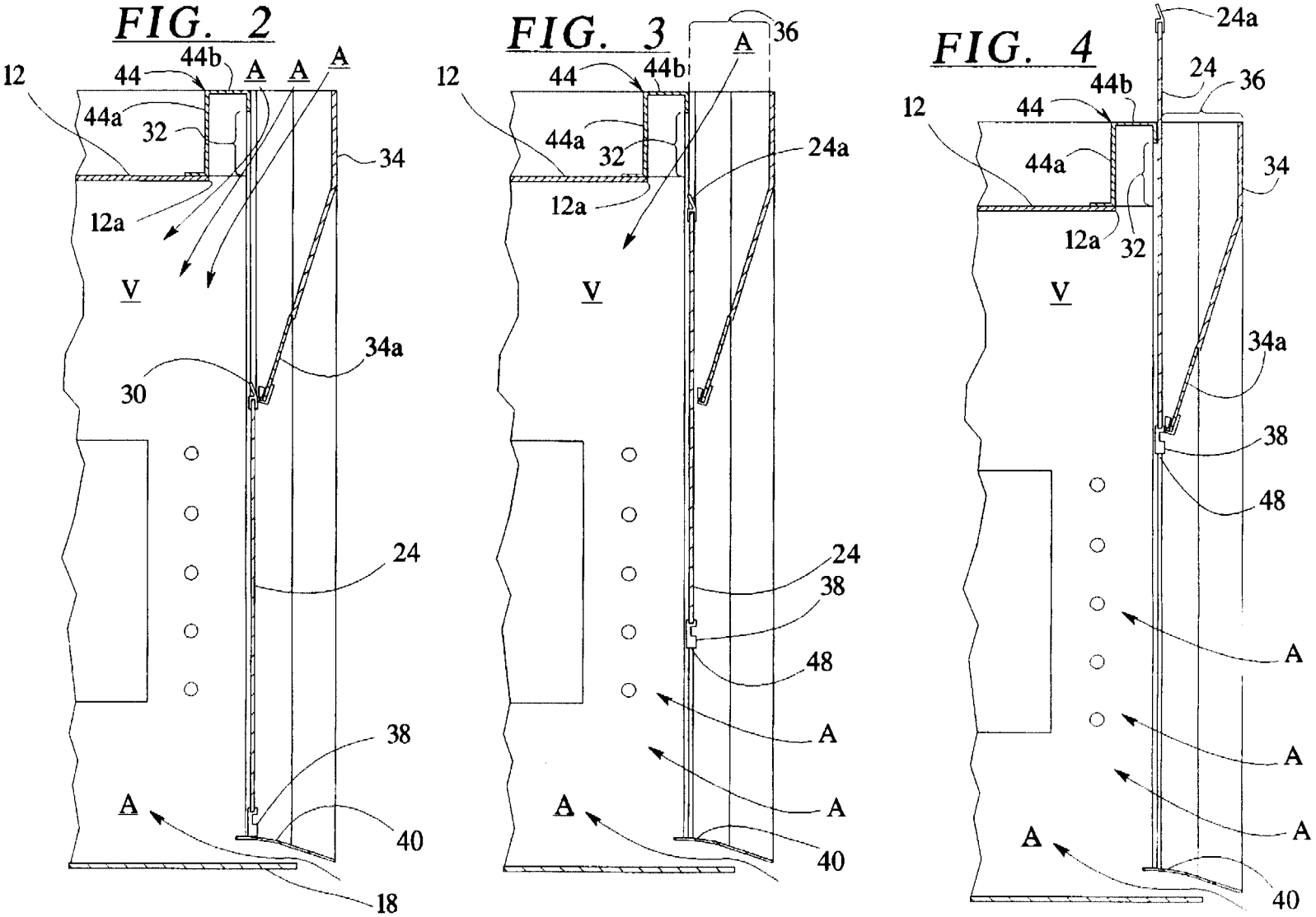
FIG. 2 is a partial sectional view taken generally along line II—II of FIG. 1.
FIG. 3 is a sectional view according to FIG. 2 but with the sash partially raised.
FIG. 4 is a partial sectional view according to FIG. 2 but with the sash fully raised.

FIG. 2 shows the sash 24 in its lowest most position. The sash provides a bottom frame member 38 which seats onto a deflector vane 40 on the bottom wall 18. In this closed configuration, air A blows through the opening 36 and under the deflector vane 40 inside the cabinet volume V. Regardless of sash position air A flows into the cabinet volume V under the deflector vane 40 across the work surface 18 keeping the surface clear of fumes. As shown in FIG. 2, a bypass channel 44 extends upward from the top panel 12 and all the way across the width of the fume hood 10. The bypass channel has a vertical leg 44*a* extending upward from the top panel 12 and a horizontal leg 44*b* extending forwardly from the vertical leg 44*a*. As illustrated in FIGS. 2–4, the top panel 12 has a forward edge 12*a* which is rearward of the plane defined by the front sash 24. The horizontal leg 44*b* of the bypass channel 44 extends forward from the vertical leg 44*a* extending to the plane defined by the front sash 24 but lies in a plane above a plane defined by the top panel 12. Thus, the bypass channel 44 creates a bypass area 32 into the working area or cabinet volume V between the edge 12*a* of the top panel 12 and a plane defined by the front sash 24. As shown in FIG. 3, when the sash 24 is partly raised such that a top edge 24*a* of the sash approaches the plane of the top wall 12, the bypass area 32 remains open so that air A may pass downwardly through the gap 36 and bypass area into the working area or cabinet volume V. When the sash is in this partly raised position, air A may also pass through a large window opening 48 beneath the bottom edge 38 of the sash 24 created by the elevation of the sash with respect to the deflector vane 40.

FIG. 4 shows the pane 24 fully raised to close off the opening 32 and require the air A to proceed through the opening 48 into the fume hood volume V.

Figure 5:
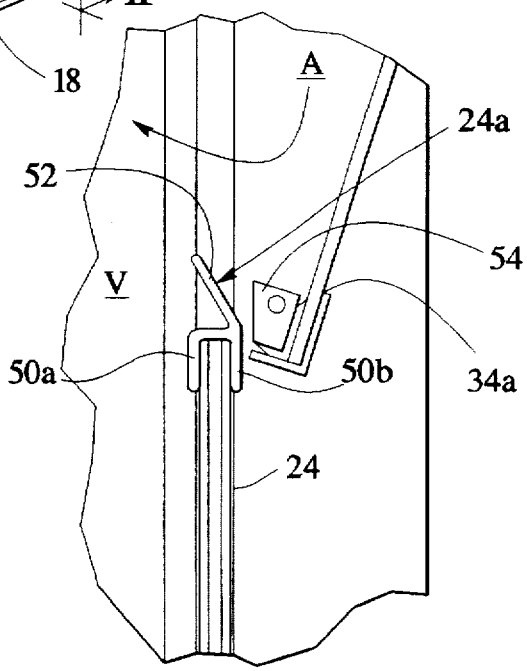
FIG. 5 is an enlarged sectional view from FIG. 2.

FIG. 5 shows the pane 24 having the top member 24*a* including a frame arrangement of pane holding side walls 50*a*, 50*b* and angular extending deflector 52 which deflects air inwardly into the fume hood volume V. A bracket 54 is used to attach the panel 34 to the hood.

The bypass channel 44 effectively extends the bypass area behind the plane of the sash while retaining a "penthouse" area behind the bypass channel 44 for mounting equipment such as a fan 56 (shown schematically in phantom) or light, and cable suspension pulleys including front pulleys 58 (one shown), back pulleys 60, 62 and a tension adjusting mechanism 66. A compact vertical arrangement up to a top extent 70 of the cover side panels 14, 16 is provided while at the same time maximizing the working area inside the fume hood 10. The bypass channel 44 has a vertical profile to fit between the top wall 12 and the top extent 70 of the cover side panels 14, 16.

Figure 6:
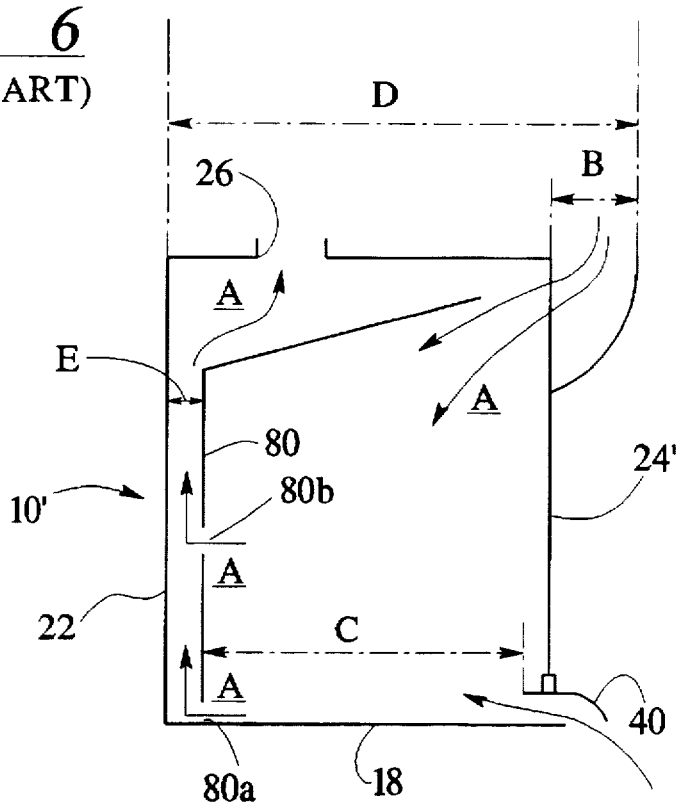
FIG. 6 (PRIOR ART)
FIG. 6 is a schematic view of a prior art fume hood.
Figure 7:
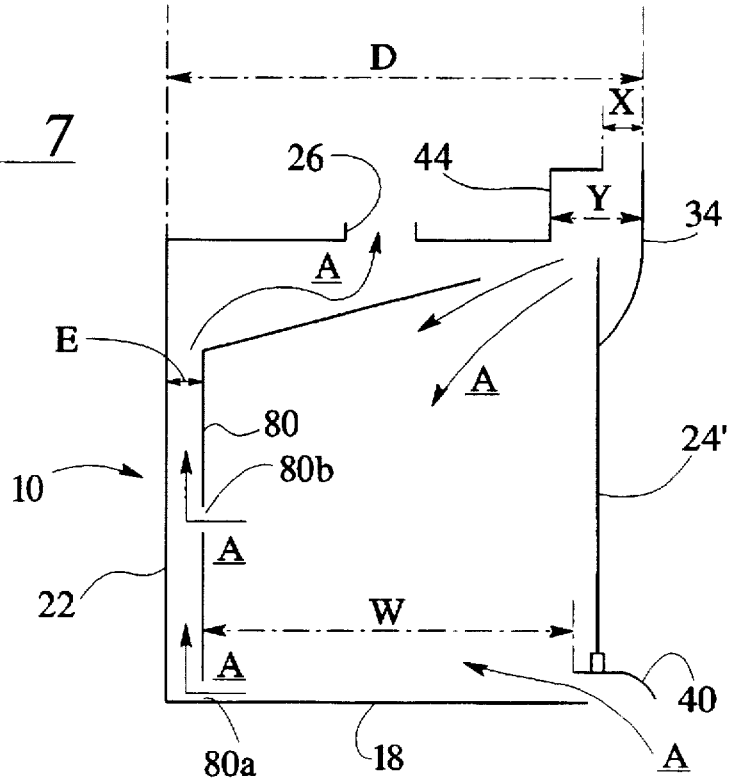
FIG. 7 is a schematic view of the fume hood of FIG. 1.

FIG. 6 and 7 demonstrate an advantage of the present invention. For the typical hood of FIG. 6, the depth dimension is D, the bypass dimension is B and the work surface dimension, inside the hood is C. A sash 24' closes the hood 10'. An internal baffle 80 directs air to the air outlet 26. The baffle 80 has appropriate openings 80*a*, 80*b* to allow air to flow behind the baffle to the air outlet 26. In comparison, the hood 10 shown in FIG. 7, having the same depth D can be provided with an increased work surface dimension W (W>C) by utilizing the smaller bypass dimension X (X<B) in conjunction with the added bypass dimension Y. The back panel 22-to-baffle 80 distance F is assumed to be constant between FIGS. 6 and 7.

Although the present invention has been described with reference to a specific embodiment, those of skill in the art will recognize that changes may be made thereto without departing from the scope and spirit of the invention as set forth in the appended claims.

We claim as my invention:

1. A laboratory fume hood, comprising:

a cabinet having a top panel lying in a top plane and an open front face lying in a front plane with an upper region and a lower region;

a bypass channel having a first leg extending upward from said top panel of said cabinet, and a second leg extending forward from said first wall, said first leg located in a plane rearward of said front plane and said second leg located in a plane above said top plane, said bypass channel defining a bypass opening between said top panel and said front plane into said cabinet;

a front panel confronting said upper region, said front panel extending outwardly from said open front face and said front plane and upwardly beyond said top plane and spaced forwardly from said second leg defining a gap therebetween;

a sash having a top edge, said sash covering a portion of said open front face and being movable between a lowered position covering said lower region, a partly raised position wherein said top edge is flush with said top plane, and a fully raised position wherein said top edge abuts against said second leg of said bypass channel; and wherein said sash permits air to enter said cabinet through said bypass area and said gap when in said lowered position, wherein said sash closes off said upper region yet permits air to enter said cabinet through said open front face and said bypass area and said gap when in said partly raised position, and wherein said sash closes off said bypass area and said upper region when in said fully raised position.

2. The fume hood according to claim 1 wherein said front panel extends obliquely away from said open face of said cabinet creating said gap between said second leg and said front panel.

3. The fume hood according to claim 1 wherein said cabinet further comprises cover side panels, said cover side panels extending upward from said top panel, and said bypass channel extends above said top panel but below a top of said cover side panels.

4. The fume hood according to claim 1 wherein said bypass channel has an inverted L-shaped cross section.

5. The fume hood of claim 1 wherein the cabinet has:

a bottom wall, a first side wall, a second side wall, and a back wall arranged and connected in an open box configuration with said front open face; and said sash has a transparent pane.

6. The laboratory fume hood of claim 1 wherein said top wall of said cabinet is a flat top wall.

* * * * *